United States Patent [19]

Sawa et al.

[11] Patent Number: 4,664,161

[45] Date of Patent: May 12, 1987

[54] AUTOMATIC FILLING APPARATUS, AND BAG MOUTH OPENING DEVICE THEREOF

[75] Inventors: Yuhji Sawa; Toshio Itoh, both of Tokyo, Japan

[73] Assignee: Kureha Chemical Industry Co., Ltd., Tokyo, Japan

[21] Appl. No.: 707,967

[22] Filed: Mar. 4, 1985

[30] Foreign Application Priority Data

| | | | |
|---|---|---|---|
| Mar. 12, 1984 | [JP] | Japan | 59-46704 |
| Mar. 12, 1984 | [JP] | Japan | 59-35096[U] |
| Mar. 12, 1984 | [JP] | Japan | 59-35097[U] |

[51] Int. Cl.[4] ..... B65B 43/04; B65B 43/36

[52] U.S. Cl. ..... 141/114; 141/314; 141/98; 141/129; 141/166; 53/384; 53/385; 53/459; 493/239

[58] Field of Search ..... 141/10, 114, 313–317, 141/129, 98, 67, 68, 165, 166, 168, 164; 53/384, 385, 459, 458, 570, 467–469; 493/234, 239

[56] References Cited

U.S. PATENT DOCUMENTS

| | | | |
|---|---|---|---|
| 3,754,370 | 8/1973 | Hanson | 53/385 X |
| 4,106,395 | 8/1978 | Rochla | 493/234 |
| 4,183,194 | 1/1980 | Lucke | 53/385 X |
| 4,345,629 | 8/1982 | Inglett, Jr. | 141/114 |
| 4,393,640 | 7/1983 | Cole et al. | 53/385 X |
| 4,484,662 | 11/1984 | Busch | 53/785 |
| 4,493,684 | 1/1985 | Bolton | 493/234 |
| 4,498,894 | 2/1985 | Kuchhermann | 493/234 |
| 4,534,154 | 8/1985 | Gaubert | 141/10 |

FOREIGN PATENT DOCUMENTS

| | | | |
|---|---|---|---|
| 2094744 | 9/1982 | United Kingdom | 53/384 |
| 0706291 | 12/1979 | U.S.S.R. | 53/384 |
| 0889545 | 12/1981 | U.S.S.R. | 53/384 |

*Primary Examiner*—Stephen Marcus
*Assistant Examiner*—Ernest G. Cusick
*Attorney, Agent, or Firm*—Rosen, Dainow & Jacobs

[57] ABSTRACT

An apparatus for automatically filling bags with a material after separating each bag from a continuous chain of bags along perforations where each bag is joined to its neighbor has a guide section for guiding the chain of bags, a separating section for separating the chain of bags into individual bags at the perforations, a mouth opening device for opening a mouth located at one side edge of each bag, and a filling section for blowing air into the bag through its opened mouth and for filling the bag through the opened mouth. The mouth opening device has a pressing assembly supported above the mouth of the bag, and a chuck assembly situated at one side of the mouth. The pressing assembly has pressing pads brought into pressured contact with an outer surface of one side sheet of the bag near its mouth, and the chuck assembly has means for moving the pressing pads toward the bottom of the bag while the pressing pads are in pressured contact with the one side sheet, and means for grasping the other side sheet of the bag at the mouth thereof as the pressing pads are moved. The mouth opening device thus grasps one side sheet of the bag and partially opens the mouth, in which state the bag is delivered to the filling section to be fully opened by the expelled air and filled while held firmly in place.

8 Claims, 9 Drawing Figures

AUTOMATIC FILLING APPARATUS, AND BAG MOUTH OPENING DEVICE THEREOF

BACKGROUND OF THE INVENTION

This invention relates to a device for opening the mouth of a closed bag in an automatic filling apparatus in order to prepare the bag for filling. The invention further relates to the automatic filling apparatus proper for processing a contiguous series of bags consisting of a plurality of bags connected in a chain at their longitudinal sides by means of perforations, with the mouths of the bags being located at one transverse side edge thereof. The automatic filling apparatus is adapted to separate the chain of interconnected bags into individual bags at the positions of the perforations, subsequently open the mouth of each bag so separated and then fill each bag with a material.

Filling a bag with a material requires opening the mouth of the bag. To this end, the practice in the prior art is to open the bag by attracting one or both of the side sheets defining the mouth through use of a suction device, or to blow air into the mouth. However, if the sheets forming the bag are thin or the sheet material exhibits adhesion, neither of the conventional methods is very effective. Moreover, a sufficient holding force for grasping the bag during filling cannot be attained, with the result that the bag often loses its shape while filling is in progress. This can lead to an improper filling operation.

One aspect of the present invention is addressed to the foregoing problems.

Further, methods of filling bags in continuous fashion have been disclosed in the specifications of Japanese Patent Application Laid-Open No. 58-112929 and Japanese Utility Model Application Laid-Open No. 58-94611. According to these disclosures, a plurality of bags formed one bag at a time in a separated state are stacked and held, and one bag at a time is extracted from the stack by suction means or the like and supplied to a filling section. Filling methods are also disclosed in the specifications of Japanese Utility Model Publication No. 53-47007 and Japanese Patent Application Laid-Open No. 52-94296, in which the mouths of a plurality of bags formed one bag at a time in a separated state are staggered and successively adhered to a strip of tape. The mouths of the bags are made to open while the tape is being fed, thus to prepare the bags for subsequent filling.

The former method is disadvantageous in that the number of bags capable of being held at one time is limited, thus necessitating the troublesome task of frequently replenishing the bags. The latter method involves higher costs stemming from the extra step of adhering the bags to the tape.

Another aspect of the present invention is intended to overcome these disadvantages.

SUMMARY OF THE INVENTION

Accordingly, a first object of the present invention is to provide a bag opening device capable of reliably opening the mouth of a bag while applying a sufficient holding force during filling, which device is applicable to an automatic filling apparatus.

A second object of the present invention is to provide an arrangement in which a plurality of bags manufactured in the form of an interconnected chain are loaded, while still interconnected, into a filling apparatus without first being separated into individual bags, and in which steps of subsequently separating the bags from the chain and of filling the bags are performed in a single line process.

A third object of the present invention is to provide a highly efficient automatic filling apparatus which utilizes the arrangement of the aforementioned second object, and which is adapted to prevent meandering of the interconnected chain of bags so that each bag will be held at a correct position during filling in order to avoid an improper filling operation.

According to the present invention, the first object is attained by providing a device for opening a mouth of a closed bag to prepare the bag for filling with a material. The bag to which the device is applied is of the type which consists of two sheets joined along their outer edges except at an edge having the mouth, and which has a bottom along an edge opposite the mouth. The device comprises a pressing assembly supported above the mouth of the bag, and a chuck assembly situated at one side of the mouth of the bag. The pressing assembly includes pressing pads exhibiting a coefficient of friction with respect to the bag that is higher than a coefficient of friction between the sheets of the bag, and means for bringing the pressing pads into pressured contact with an outer surface of one of the sheets of the bag near the mouth thereof. The chuck assembly has means for moving the pressing pads toward the bottom of the bag while the pressing pads are in pressured contact with the one sheet of the bag, and means for grasping the other sheet of the bag at the mouth thereof as the pressing pads are moved.

The second object of the invention is attained by providing an apparatus for filling individual bags with a material after separating each bag from a continuous chain of plural bags along perforations where each bag is joined at a longitudinal side edge to a longitudinal side edge of its neighbor, each bag having a mouth at one transverse side edge thereof. The apparatus comprises guide means for guiding the chain of bags into the apparatus, separating means for separating the chain of bags received from the guide means into individual bags at the perforations, mouth opening means for opening the mouth of each individual bag received from the separating means in order to prepare the bag for filling, filling means for filling the individual bag received from the mouth opening means with the material through the opened mouth of the bag, and conveyance means for conveying the individual bag from the separating means to the mouth opening means and from the mouth opening means to the filling means.

The guide means delivers the chain of bags, pulled from a bag supply having the form of a roll, stack or other configuration, to the separating means while the chain is held at a correct position in the width direction thereof. When a bag separated from the chain is filled, the mouth of the bag is grasped constantly at a prescribed position to avoid an improper filling operation. The guide means includes an elongated guide roller disposed between the separating means and a support for the chain of bags, and a position regulating member attached to the guide roller for contacting and positioning an edge of the chain.

The separating means is adapted to separate a bag from the chain of bags at the perforations and includes a first pair of pinch rollers and a second pair of pinch rollers adjacent to the first pair downstream thereof in the direction of conveyance. The second pair of pinch rollers, disposed closer to the mouth opening means than the first pair, is set to a feed speed greater than that of the first pair when a bag is to be separated from the chain of bags. Owing to the difference in speed, tension is applied to the chain of bags to separate the leading bag from the chain at the perforations. In a preferred embodiment, the first and second pairs of pinch rollers are rotated at the same speed until a row of performations arrives at a position between each pair. At such time the rotation of the first pair of pinch rollers is reduced in speed or brought to a stop to effect the separation by so tensioning the chain of bags. In other words, it will suffice if the feed speed of the second pair of pinch rollers is made higher than that of the first pair when a bag is to be separated from the chain.

According to the present invention, the third object is attained by providing an arrangement in which mouth opening means and filling means of the following construction are provided in addition to the above-described separating means. Specifically, the mouth opening means fundamentally is of the same construction as the mouth opening device of the first object and includes a pressing assembly for opening the mouth of a separated bag, and a chuck assembly for grasping the inner side of the opened mouth.

The pressing assembly is disposed above the mouth of the separated bag and has pressing pads for moving one sheet of the bag toward the bottom of the bag while applying pressure to the outer surface of the sheet in the vicinity of the mouth. The pressing pads are made of a material which will afford a coefficient of friction between the pressing pads and the bag that is greater than that between the opposing sheets of material constituting the bag. The chuck assembly is located alongside the mouth of the separated bag and is moved in parallel with the separated bag at a speed identical with that at which the separated bag is conveyed. The pressing pads are moved toward the bottom of the separated bag to open the mouth thereof, at which time the other sheet of the separated bag is grasped at the mouth.

The filling means comprises a blower for blowing air into the separated bag, which is being grasped by the chuck assembly, through the mouth of the bag, and a piston body for filling the separated bag with a material through the mouth of the bag opened widely by the expelled air. If the arrangement is such that the holding force of the chuck assembly is increased at filling, this will eliminate any risk of the bag being pulled free of the chuck even when the piston body applies a large stuffing force as may be required depending upon the type of material to be introduced into the bag. Such an arrangement is desirable in view of greater reliability.

In a preferred embodiment, the above arrangement has guiding means in which a position regulating member for regulating the position of an edge of the chain of bags is attached to a guide roller located upstream of the separating means for feeding and guiding the chain of bags thereto.

The mouth opening device of the above-described construction makes it possible to open the mouth of a bag in reliable fashion and to grasp one sheet of the bag at its mouth by use of the chuck assembly. The mouth therefore can be opened widely to facilitate filling and the bag will not collapse or lose its shape even when stuffed with a material introduced under a strong force. This prevents an improper filling operation. Moreover, if the holding force applied by the chuck assembly is increased during filling, the filling operation can be performed under greater force to improve its performance. The mouth opening device is capable of being applied to, and of raising the efficiency of, an automatic filling machine of the type that separates a bag from a chain of bags and then fills the bag in a single series of operations.

The automatic packing apparatus which incorporates the above-described mouth opening device is adapted to pull the chain of bags from a supply of bags and then separate a bag from the chain. Once the supply of bags has been set in position, therefore, a large number of bags can be filled in continuous fashion to provide improved efficiency. Furthermore, since the mouth opening and bag filling operations can be performed consecutively immediately upon bag separation, fewer steps are required. By providing the guide means with the position regulating member, moreover, meandering of the chain of bags is prevented so that the bags can be opened and filled at a prescribed position at all times. This assures that the holding force applied to the bag during filling will be maintained, thereby preventing the bag from slipping at such time. This eliminates the risk of improper filling and, hence, enhances reliability. If the holding force applied by the chuck assembly is increased during filling, the filling operation can be performed under greater force to improve its performance.

Other features and advantages of the present invention will be apparent from the following description taken in conjunction with the accompanying drawings, in which like reference characters designate the same or similar parts throughout the figures thereof.

DESCRIPTION OF THE PREFERRED EMBODIMENT

The overall system embodying the present invention will now be described with reference to the drawings.

Figure 1:
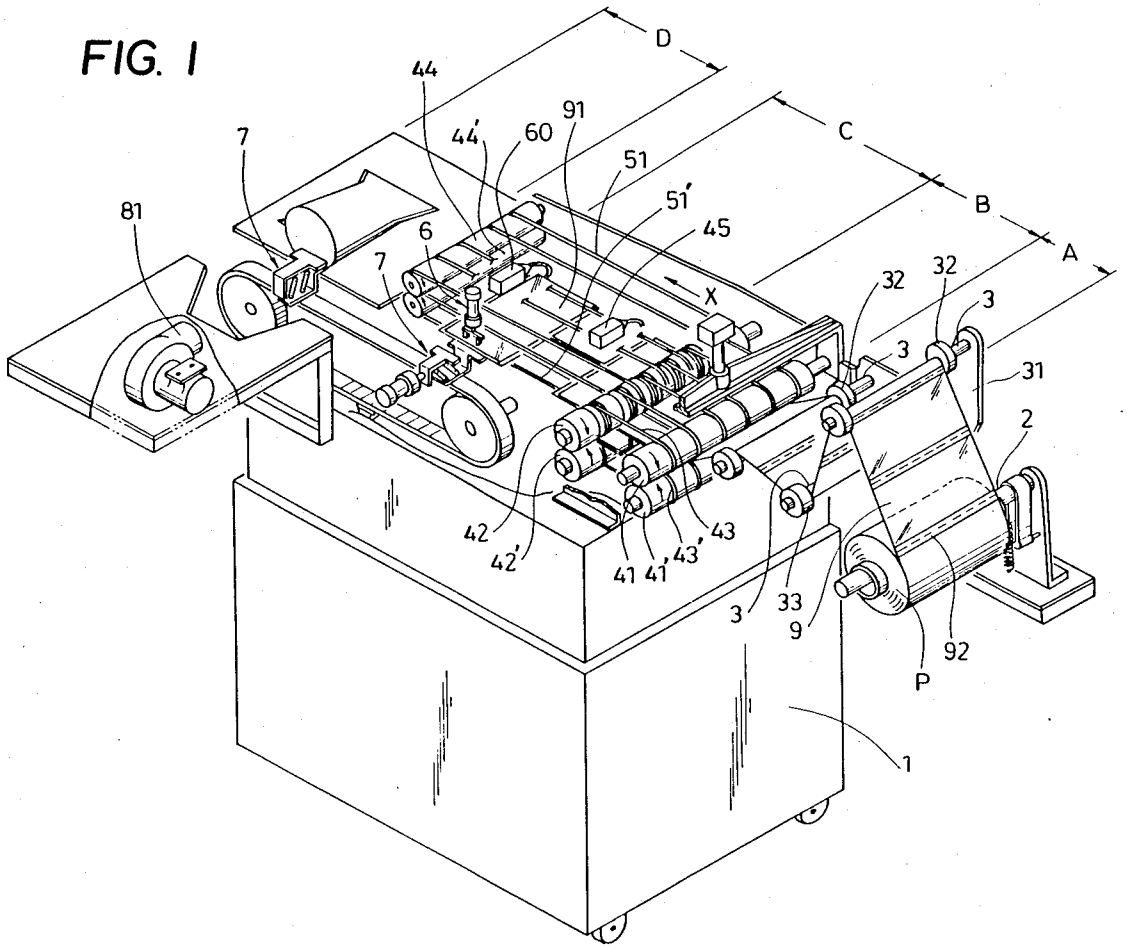
FIG. 1 is a perspective view illustrating a system embodying the present invention, in which interconnected bags taken from a roll thereof are filled.

FIG. 1 is a perspective view of the system which, in the illustrated embodiment, processes a chain 9 of interconnected bags taken from a roll P. The bag chain 9 consists of a multiplicity of bags each of which is connected to its neighbors by perforations along the longitudinal side edges thereof, with the mouth of each bag being located on the left-hand side of the chain as seen in the direction of feed indicated by the arrow X. The system includes a frame 1 the right-hand side of which is provided with a roll support arm 2 for rotatably supporting the roll P of interconnected bags. Disposed on the upper side of the frame 1 downstream of the support arm 2 as veiwed in the direction of feed are a guide section A, a separating section B, a mouth opening section C, and a filling section D, in the order mentioned.

The guide section A includes a support arm 31 extending from the frame 1, and elongaged guide rollers 3 rotatably supported by the support arm 31, and is adapted to guide the chain 9 of bags in the direction of feed. Though three guide rollers 3 are provided in the illustrated embodiment, one alone will suffice. Set on each guide roller 3 near the right-hand end thereof is a regulating roller 32 serving as a positioning member for regulating the position of the right-hand side edge of the bag chain 9 in such a manner that the bags will be fed or conveyed while in a correct position in the direction of the width thereof at subsequent steps. Attached securely to the left-hand end of each guide roller 3 is a reference roller 33 for setting a reference position of the chain 9 in the width direction of the bags.

Figure 6:
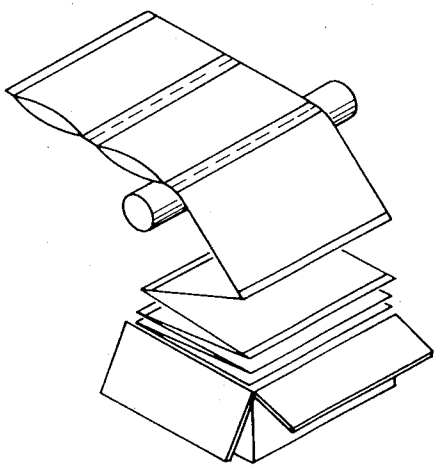
FIG. 6 is a perspective view illustrating interconnected bags taken from a folded stack thereof capable of being applied to the system of FIG. 1.

It should be noted that interconnected bags in folded form as shown in FIG. 6 can be applied to the guide section A in an entirely similar manner.

The separating section B comprises a first pinch roller pair 41, 41' and a second pinch roller pair 42, 42'. Stretched between the two upper pinch rollers 41, 42 and the two lower pinch rollers 41', 42' are a plurality of belts 43, 43', respectively, for feeding the chain 9 of bags while embracing the bags from the upper and lower sides thereof. Disposed between the first and second roller pairs is a first sensor 45 for sensing the perforations 92 between mutually adjacent bags of the chain 9. In response to a signal produced by the first sensor 45 upon sensing the perforations, rotation of the first pinch roller pair 41, 41' is halted, immediately after which the upper pinch roller 41 is raised slightly to bring the rollers out of pressured engagement. The arrangement is such that the upper pinch roller 41 will be restored to its original position in pressured engagement with the lower pinch roller 41' prior to a bag separating operation, described below, performed along the next row of perforations. Disposed further downstream of the separating section B in the direction of feed is a third pinch roller pair 44, 44'. Conveyor belts 51 are stretched between the upper pinch rollers 42, 44 of the second and third pinch roller pairs, respectively, and conveyor belts 51' are stretched between the lower pinch rollers 42', 44' of the second and third pinch roller pairs, respectively.

The bag mouth opening section C is disposed downstream of the separating section B in the direction of the arrow X at a position corresponding to the mouth at the left-hand side edge of a bag 91 conveyed by the belts 51, 51' following separation of the bag 91 from the chain 9 in a manner set forth below. The mouth opening section C comprises a pressing assembly 6 situated above the mouth of the bag 91 for opening the mouth, and a chuck assembly 7 located alongside the mouth for grasping the opened mouth and transporting the bag 91 to the filling section D under such condition.

Figure 2:
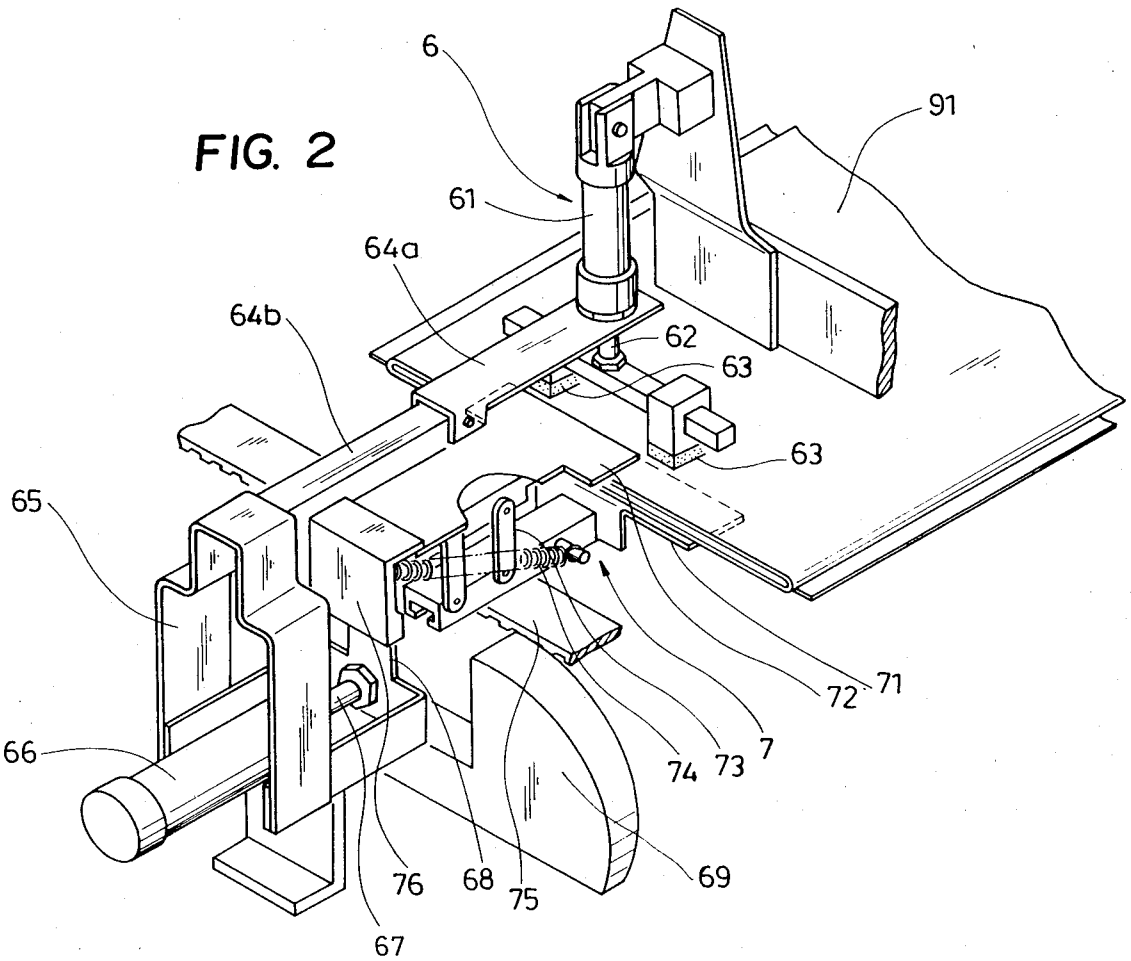
FIG. 2 is a perspective view illustrating the arrangement of a bag mouth opening section.

As shown in detail in FIG. 2, the pressing assembly 6 includes an air cylinder 61 pivotally supported at its upper end portion, a rod 62 operatively associated with the air cylinder 61 and reciprocated up and down thereby, and pressing pads 63 attached to the lower or distal end of the rod 62 at positions suitable for applying pressure to the mouth of the bag 91. The lower portion of the air cylinder 61 is connected to a horizontally actuated rod 67 of another air cylinder 66 via pivotally connected horizontal levers **64*a*, 64*b* and a vertical lever 65. The end of the lever 64*a* opposite the connection to the lever 64*b* is secured to the air cylinder 61. The end of the lever 64*b* opposite the connection to the lever 64*a* is pivotally connected to the vertical lever 65. The pressing pads 63 are made of a material which will afford a coefficient of friction between the pressing pads 63 and the bag 91 that is greater than that between the opposing sheets of material constituting the bag 91. The two air cylinders 61, 66 are so arranged that the rod 67 of the latter will be thrust toward the bottom of the bag 91 (i.e., rightward in FIG. 2) immediately after the rod 62** of the former is lowered.

The chuck assembly 7 includes upper and lower jaws 71, 72 capable of being opened and closed. The lower jaw 71 is attached to a belt 75 which travels at a speed equivalent to that at which the bag 91 is conveyed. The upper jaw 72 is connected to the lower jaw 71 by parallel links 73. Stretched under tension between the upper and lower jaws 71, 72 is a spring 74 which produces a force that pitches the upper jaw 71 forward into pressure against the lower jaw 72. The aft end of the upper jaw 72 is bent into an L-shaped portion 76. A locking piece 68 is attached to the distal end of the rod 67 operatively associated with the air cylinder 66 and is adapted to be brought into abutting locking contact with the L-shaped portion 76 of the upper jaw 72 to hold the upper jaw open against the force of the spring 74. A cam plate 69 is provided in parallel relation to the locking piece 68 at a position somewhat upstream as viewed in the direction of conveyance. As the belt 75 travels, the L-shaped portion 76 of the upper jaw 72 is gradually engaged by the cam plate 69, with the result that the parallel links 73 are eventually brought into an upstanding attitude. To this end, the cam plate 69 is formed to have a thickness which gradually increases in the direction of conveyance so that the back surface of the cam plate 69 which comes into sliding engaging contact with the L-shaped portion 76 will cause the latter to retract and, hence, erect the parallel links 73. The arrangement is such that the L-shaped portion 76 is engaged and locked by the locking piece 68 when the former comes free of the cam plate 69.

A second sensor 60 for sensing the leading edge of the bag 91 is disposed upstream of the third pinch roller pair 43, 43' as seen in the direction of conveyance. The second sensor 60 operating in association with a timer, not shown, produces a signal to actuate the air cylinder 61 when the central portion of the bag 91 arrives at the position of the pressing assembly 6, the signal being issued at a moment which depends upon the width of the bag 91, the conveyance speed and the distance between the second sensor 60 and the pressing assembly 6.

The filling section D includes a blower 81 for blowing air into the mouth of the bag 91 of which the sheet on the lower side is grasped at the mouth portion by the chuck assembly 7 in a manner described in detail below, and a piston body (not shown) for stuffing a material into the bag 91 through the mouth thereof opened widely by the blown air. It should be noted that the aforementioned chuck assembly 7 preferably applies an increased holding force to the bag during the filling operation performed by the piston body.

Figure 3:
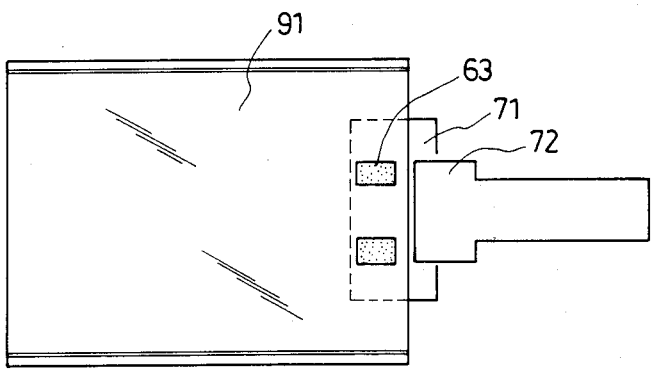
FIGS. 3 through 5 illustrate the operating sequence of the bag mouth opening section of FIG. 2, in which (A) and (B) of each Figure are plan and front views, respectively.
Figure 3:
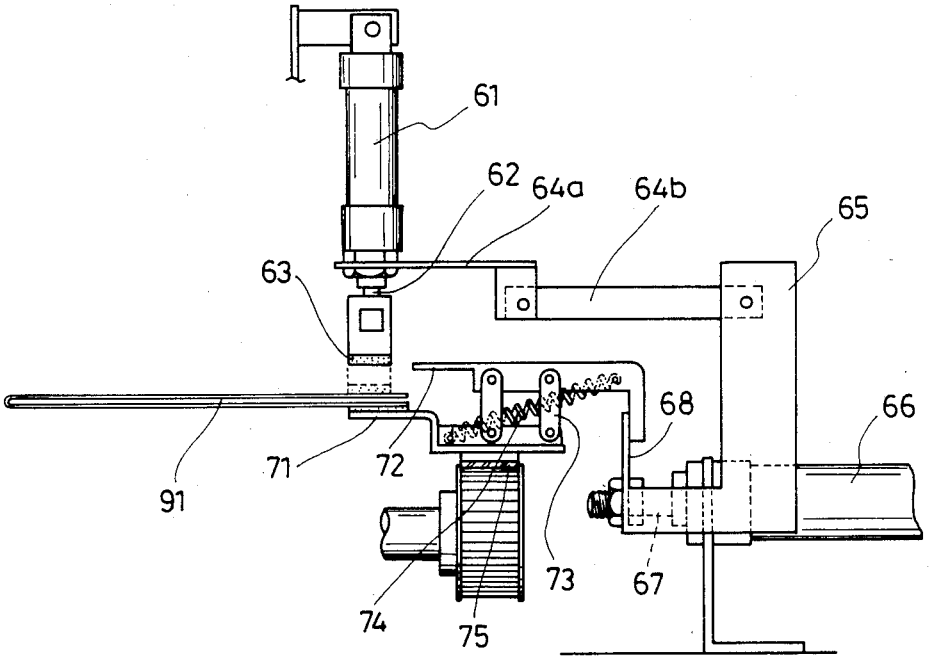
Figure 4:
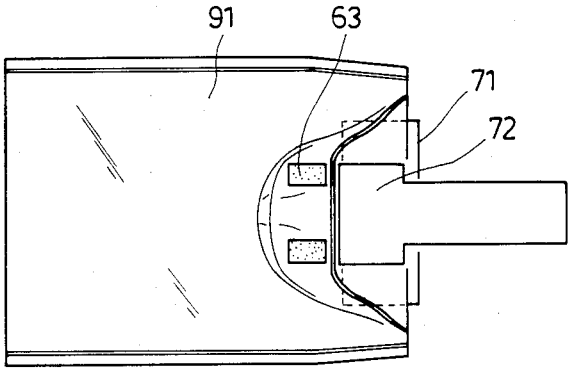
Figure 4:
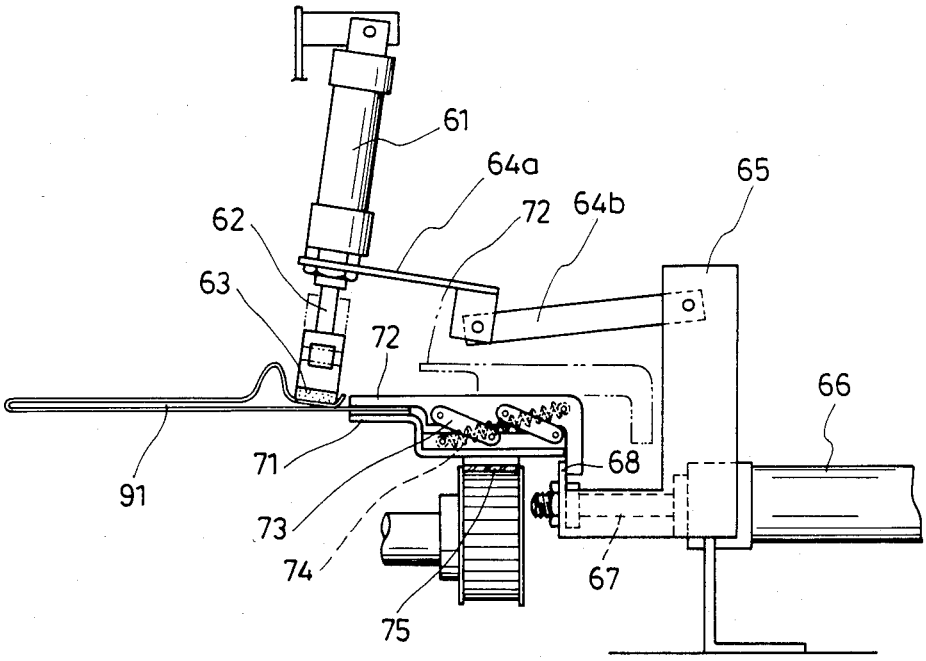
Figure 5B:
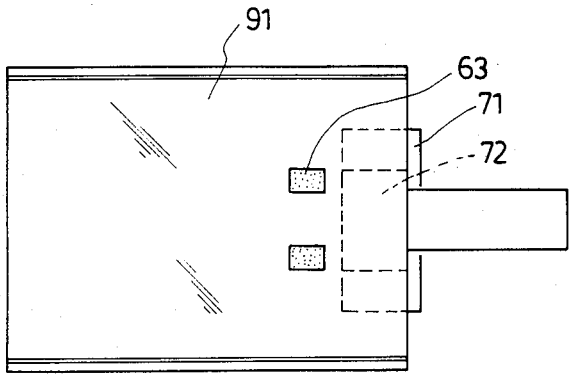
Figure 5:
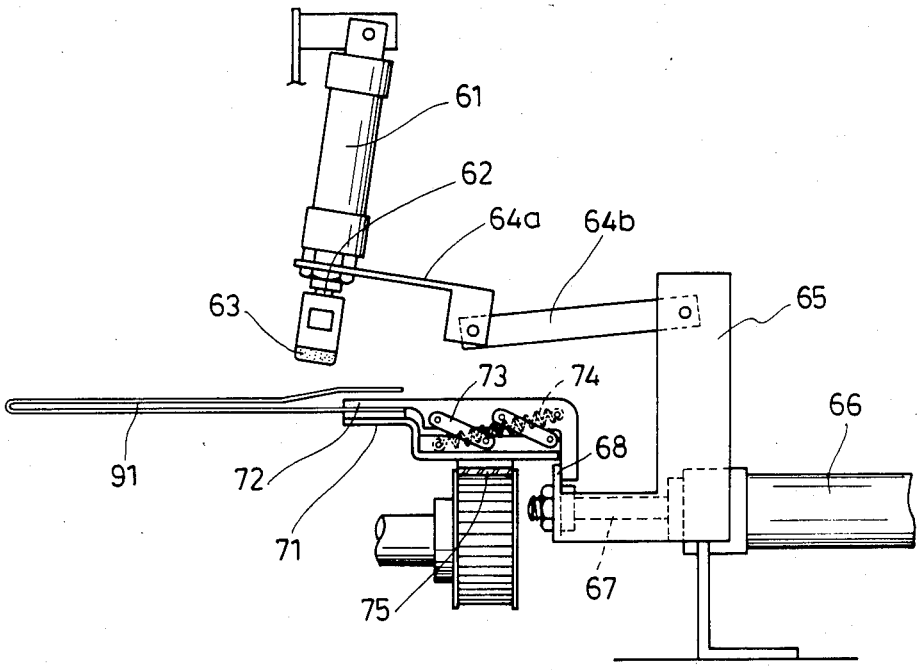

The operation of the foregoing embodiment will now be described with reference to FIGS. 1 and 2 and also in conjunction with FIGS. 3 through 5 illustrating the operating sequence of the pressing assembly 6.

First, the leading edge of the chain of bags 9 is pulled from the roll P in FIG. 1 and guided into the first pinch roller pair 41, 41' of the separating section B by the guide rollers 3 of the guide section A. The chain of bags 9 is fed into the second pinch roller set 42, 42' by the first pinch roller set 41, 41' after which the first sensor 45 senses the leading edge of the chain. When this occurs, the sensor 45 issues a signal to halt rotation of the first pinch roller set 41, 41' but not of the second pinch roller set 42, 42'. Since the sensor 45 issues the aforementioned signal just when the first row of perforations 92 is located between the first and second pinch roller sets, rotation of the second pinch roller set relative to the halted first pinch roller set tensions the bag chain 9 in the direction of conveyance so that the first bag in the chain is separated from the chain at the perforations 92. The result is the independent bag 91. Immediately thereafter, the upper pinch roller 41 of the first pair is raised to free the remaining chain 9 from the clamping force. This will enable any widthwise positional deviation experienced by the chain of bags to be corrected by urging the chain against the reference rollers 33 through use of the regulating rollers 32 attached to the respective guide rollers 33 of the guide section A.

When a prescribed period of time expires, the upper pinch roller 41 is lowered back down to the pinch roller 41' so that the two rollers may then proceed to feed the new leading edge of the remaining bag chain 9 into the second pinch roller pair 42, 42'.

Meanwhile, the independent bag 91 separated from the chain as described above is conveyed to the mouth opening section C while in the embrace of the belts 51, 51'. Upon sensing the leading edge of the bag 91, the second sensor 60, in cooperation with the aforementioned timer, actuates the pressing assembly 6 when the central portion of the bag 91 arrives at the position of the pressing assembly. More specifically, as shown in FIG. 3, the rod 62 of the air cylinder 61 is lowered to bring the pressing pads 63 into pressured contact with the upper surface of the sheet forming the upper side of the bag 91. Concurrently, the chuck assembly 7 attached to the belt 75 is advanced thereby in the direction of conveyance so that the L-shaped portion 76 at the aft end of the upper jaw 72 constituting the chuck assembly 7 starts to engage the cam plate 69. As the chuck assembly 7 advances, the L-shaped portion 76 is retracted or drawn away from the edge of the bag, thereby erecting the parallel links 73 of the chuck assembly 7 against the force of the spring 74. As the chuck assembly 7 is advanced further, the L-shaped portion 76 thereof comes free of the cam plate 69 and, with the parallel links 73 in an upstanding attitude, engages the locking piece 68 attached to the distal end of the rod 67 actuated by the air cylinder 66. This condition is shown in FIG. 3(A). Next, the rod 67 is thrust forward by the air cylinder 66, causing the pressing pads 63 to slide the upper sheet of the bag 91 at the mouth thereof toward the bottom of the bag by virtue of a frictional force applied to the upper sheet. Such movement of the pressing pads 63 is made possible by the pivotally supported upper end of the air cylinder 61 and the pivotal connection between the levers 64*a*, 64*b* and between the lever 64*b* and the lever 65. Meanwhile, with the forward thrust of the rod 67, the upper jaw 72 of the chuck assembly 6 is pitched forward by the action of the spring 74 so that the sheet constituting the lower side of the bag 91 is clamped at the mouth of the bag between the upper jaw 72 and the lower jaw 71. The condition which prevails at this time is illustrated in FIGS. 4(A) and (B). This is followed by causing the air cylinder 61 to raise the rod 62, as shown in FIGS. 5(A) and (B), so that the bag 91 may be freed from the pressing pads 63 in order to be conveyed to the next section.

The bag 91 grasped by the chuck assembly 7 in the above-described manner is now conveyed to the filling section D by the belt 75 to which the chuck assembly 7 is attached. Here the mouth of the bag 91 is opened widely by air expelled from the blower 81, and the interior of the bag is filled with a material introduced through the mouth of the bag by the piston body, not shown.

Since the speed at which the bag is conveyed from the second pinch roller pair 42, 42' to the filling section D is set to an appropriate value, the various operations performed between these two stations can be executed without requiring that the bag be stopped in transit.

As many apparently widely different embodiments of the present invention can be made without departing from the spirit and scope thereof, it is to be understood that the invention is not limited to the specific embodiments thereof except as defined in the appended claims.

What we claim is:

1. A device for opening the mouth of a closed bag to prepare the bag for filling with a material, the bag including two sheets positioned one overlapping the other and joined along their outer edges except for an unjoined edge portion forming said mouth, the bag having its bottom located at the end of said bag opposite said mouth, said bag being one of a continuous chain of plural bags where each bag is joined side to side by perforations at a longitudinal side edge to a longitudinal side edge of its neighbor, each bag having said mouth at one transverse edge thereof, comprising:

guide means for guiding the chain of bags from a supply of connected bags into the device;

separating means for separating the chain of bags received from said guide means into individual bags at the perforations;

conveyance means for moving said separated bag to mouth opening means from said separating means;

mouth opening means having at least one pressing pad exhibiting a coefficient of friction with respect to the bag that is higher than the coefficient of friction between the sheets of the bag, said pad being spaced from said individual bags and means for bringing said at least one pressing pad into pressured contact with an outer surface of one of the sheets of the individual bag near the mouth thereof, a chuck assembly having means for moving said at least one pressing pad toward the bottom of the bag while said at least one pressing pad is in said pressure contact with said one sheet of the bag, said pad movement frictionally moving said one sheet to expose a portion of the other sheet, and means for grasping the exposed portion of said other sheet of the bag at mouth thereof, said grasping being initiated as said at least one pressing pad is moved by the moving means.

2. The device according to claim 1, wherein said chuck assembly has means for increasing the force at which said chuck assembly grasps the other sheet of the bag.

3. A device for opening the mouth of a closed bag to prepare the bag for filling with a material, the bag including two sheets positioned one overlapping the other and joined along their outer edges except for an unjoined edge portion forming said mouth, the bag having its bottom located at the end of said bag opposite said mouth, said bag being one of a continuous chain of plural bags where each bag is joined by perforations at a longitudinal side edge to a longitudinal side edge of its neighbor, each bag having said mouth at one transverse side edge thereof, comprising:

guide means having a guide roller for guiding the chain of bags from a supply of connected bags into the apparatus, and a position regulating member attached to said guide roller for contacting and positioning a side edge of the chain of bags;

separating means for separating the chain of bags received from said guide means into individual bags at the perforations;

mouth opening means having at least one pressing pad exhibiting a coefficient of friction with respect to the bag that is higher than the coefficient of friction between the sheets of the bags, and means for bringing said at least one pressing pad into pressured contact with an outer surface of one of the sheets of the bag near the mouth thereof, a chuck assembly having means for moving said at least one pressing pad toward the bottom of the bag while said pressing pad is in said pressured contact with said one sheet of the bag, and means for grasping the other sheet of the bag at the mouth thereof as said pressing pad is moved by the moving means;

conveyance means for conveying the individual bag from said separating means to said mouth opening means;

said separating means having a first pair of pinch rollers, and a second pair of pinch rollers adjacent to said first pair of pinch rollers downstream thereof in the direction of conveyance, said first pair of pinch rollers applying a pinching force to the chain of bags and said second pair of pinch rollers being set to a feed speed greater than that of said first pair of pinch rollers when a bag is to be separated from the chain of bags, said first pair of pinch rollers being set to remove the pinching force between separation operations.

4. A device as claimed in claim 3, wherein said first and second pairs of pinch rollers are rotated at identical speeds between separation operations, and rotation of said first pair of pinch rollers is halted when a bag is separated from the chain of bags.

5. An apparatus for opening the mouth of a closed bag for filling individual bags with a material after separating each bag from a continuous chain of plural bags along perforations where each bag is joined at a longitudinal side edge to a longitudinal side edge of its neighbor, each bag having a mouth at one transverse side edge thereof and consisting of two sheets positioned one overlapping the other and joined along their outer edges except at the edge having said mouth, the bag having its bottom located at the end of said bag opposite said mouth, comprising:

guide means for guiding the chain of bags into the apparatus;

separating means for separating the chain of bags received from said guide means into individual bags at the perforations;

mouth opening means for opening the mouth of each individual bag received from said separating means;

conveyance means for conveying the individual bag from said separating means to said mouth opening means;

said separating means having a first pair of pinch rollers, and a second pair of pinch rollers adjacent to said first pair of pinch rollers downstream thereof in the direction of conveyance, said first pair of pinch rollers applying a pinching force to the chain of bags and said second pair of pinch rollers being set to a feed speed greater than that of said first pair of pinch rollers when a bag is to be separated from the chain of bags, said first pair of pinch rollers being set to remove the pinching force between separation operations;

said mouth opening means comprising a pressing assembly supported adjacent the mouth of the individual bag, and a chuck assembly situated at one side of the mouth of the individual bag and movable in parallel with the individual bag at a speed identical with that at which the individual bag is conveyed;

said pressing assembly having pressing pads exhibiting a coefficient of friction with respect to the individual bag that is higher than a coefficient of friction between the sheets of the bag, and means for bringing said pressing pads into pressured contact with an outer surface of one of the sheets of the individual bag near the mouth thereof;

said chuck assembly having means for moving said pressing pads toward the bottom of the individual bag while said pressing pads are in pressured contact with the one sheet of the bag, and means for grasping the other sheet of the individual bag at the mouth thereof as said pressing pads are moved by the moving means;

a blower for blowing air into the mouth of the individual bag the other sheet of which is grasped by the grasping means of said chuck assembly.

6. The apparatus according to claim 5, wherein said first and second pairs of pinch rollers are rotated at identical speeds between separation operations, and rotation of said first pair of pinch rollers is halted when a bag is separated from the chain of bags.

7. The apparatus according to claim 5, wherein said chuck assembly has means for increasing the force at which said chuck assembly grasps the other sheet of the individual bag.

8. A mouth opening apparatus for opening a closed bag for filling individual bags with a material after separating each bag from a continuous chain of plural bags along perforations where each bag is joined at a longitudinal side edge to a longitudinal side edge of its neighbor, each bag having said mouth at one transverse side edge thereof and consisting of two sheets joined along their outer edges except at the edge having said mouth, the bag having its bottom located at the end of said bag opposite said mouth, comprising:

guide means for guiding the chain of bags into the apparatus;

separating means for separating the chain of bags received from said guide means into individual bags at the perforations;

mouth opening means for opening the mouth of each individual bag received from said separating means;

conveyande means for conveying the individual bag from said separating means to said mouth opening means;

said guide means having a guide roller for guiding the chain of bags into the apparatus, and a position regulating member attached to said guide roller for contacting and positioning a side edge of the chain of bags;

said separating means having a first pair of pinch rollers, and a second pair of pinch rollers adjacent to said first pair of pinch rollers downstream thereof in the direction of conveyance, said first pair of pinch rollers applying a pinching force to the chain of bags and said second pair of pinch rollers being set to a feed speed greater than of first pair of pinch rollers when a bag is to be separated from the chain of bags, said first pair of pinch roller being set to remove the pinching force between separation operations;

said mouth opening means comprising a pressing assembly supported adjacent the mouth of the individual bag, and a chuck assembly situated at one side of the mouth of the individual bag and movable in parallel with the individual bag at a speed identical with that at which the individual bag is conveyed;

said pressing assembly having pressing pads exhibiting a coefficient of friction with respect to the individual bag that is higher than the coefficient of friction between the sheets of the bag, and means for bringing said pressing pads into pressured contact with an outer surface of one of the sheets of the individual bag near mouth thereof;

said chuck assembly having means for moving said pressing pads toward the bottom of the individual bag while said pressing pads are in pressured contact with the one sheet of the bag, and means for grasping the other sheet of the individual bag at the mouth thereof as said pressing pads are moved by the moving means; and a blower for blowing air into the mouth of the individual bag the other sheet of which is grasped by the grasping means of said chuck assembly.

* * * * *

UNITED STATES PATENT AND TRADEMARK OFFICE

CERTIFICATE OF CORRECTION

PATENT NO. : 4,664,161

DATED : May 12, 1987

INVENTOR(S) : Yuhji Sawa et al.

It is certified that error appears in the above-identified patent and that said Letters Patent is hereby corrected as shown below:

In the title: "AUTOMATIC FILLING APPARATUS, AND BAG MOUTH OPENING DEVICE THEREOF" to --APPARATUS FOR BAG MOUTH OPENING--.

Column 11, line 7, after "greater than" insert --that--.

Signed and Sealed this

Twenty-second Day of March, 1988

*Attest:*

DONALD J. QUIGG

*Attesting Officer*

*Commissioner of Patents and Trademarks*